US006301857B1

(12) United States Patent
Vrana

(10) Patent No.: US 6,301,857 B1
(45) Date of Patent: Oct. 16, 2001

(54) COMPOSITE STRUCTURAL MEMBER

(76) Inventor: Jan Vrana, 111 Vanguard Avenue, Pointe Claire, Québec (CA), H9R 3T4

( * ) Notice: Subject to any disclaimer, the term of this patent is extended or adjusted under 35 U.S.C. 154(b) by 0 days.

(21) Appl. No.: 09/348,080

(22) Filed: Jul. 6, 1999

(51) Int. Cl.[7] ..... E04C 3/30

(52) U.S. Cl. ..... 52/730.1; 52/729.1; 52/718.01; 52/729.5; 52/690; 52/694; 411/523; 411/522; 411/457; 411/461; 411/466; 411/921

(58) Field of Search ..... 52/800.1, 718.01, 52/729.1, 729.5, 730.1, 690, 694; 411/522, 523, 457, 461, 466, 921

(56) References Cited

U.S. PATENT DOCUMENTS

| | | | | |
|---|---|---|---|---|
| 2,500,940 | | 3/1950 | Fischer et al. . | |
| 4,281,497 | * | 8/1981 | Luotonen et al. | 52/730 |
| 4,937,998 | * | 7/1990 | Goldberg | 52/729 |

* cited by examiner

*Primary Examiner*—Carl D. Friedman
*Assistant Examiner*—Christy M. Syres

(57) ABSTRACT

The invention is particularly directed toward a structural member comprising an elongate metal flange having a pair of parallel side walls joined at one end by a transverse base wall to form a web receiving pocket. Each side wall has a plurality of raised teeth, each tooth having a body portion bent outwardly from the side wall along a first line transverse to the longitudinal direction of the flange, and a penetrating point portion at the free end of the body portion, bent along a second line parallel to the first line, to extend toward the socket. The invention is also directed toward a composite structural member employing the flange with a web having opposed edge portions. One edge portion of the web is mounted in the pocket of the flange and the teeth on the flange are pressed into the web to joint the web and flange together. The invention is further directed toward a method of making the composite structural member using the metal flange.

20 Claims, 3 Drawing Sheets

COMPOSITE STRUCTURAL MEMBER

BACKGROUND OF THE INVENTION

1. Field of the Invention

This invention is directed toward an improved structural member, and more particularly to a metal flange to be used in making a composite structural member. The invention is also directed toward an improved composite structural member, and more particularly to an I-beam member having a web with a metal flange attached to at least one, and preferably both, edges of the web. The invention is further directed toward a method for making the composite structural member.

2. Description of the Related Art Including Information Disclosed Under CFR §§ 1.97–1.99

Composite structural members are well known. These members often employ a wooden web with wooden flanges attached on both edges of the web to form composite structural members such as I-beams. Composite I-beams are also known that employ wooden flanges with a steel web; steel flanges with a steel web; and steel flanges with a wooden web. The known composite I-beams have various disadvantages however depending on their structure. All composite wooden I-beams are weaker than beams of the same general size employing metal. In addition, the attachment of the wooden flange to the wooden web is often by gluing and the gluing process is time consuming and costly. All composite metal beams are more expensive than beams of the same general size employing wood. These beams are normally too costly for use in residential and light commercial buildings, and if used in such locations are unnecessarily strong. Composite beams employing wood flanges with a steel web are difficult to construct and thus expensive. It is difficult to make the connection between the wood flanges and the steel web strong enough. If the webs are full, they increase the cost of the beam and also make it difficult to provide access openings for the passage of wires and pipes. If the metal webs open, this usually results in smaller attachment areas between the web and the flanges resulting in poor connections which result in creep in the beam and less strength. Composite beams employing a wooden web with steel flanges are relatively inexpensive and relatively strong. However these beams are still relatively expensive to construct. In addition, the beam can have a strength problem in the connection between the web and flanges due to the construction of the flange normally employed.

SUMMARY OF THE INVENTION

It is a purpose of the present invention to provide an improved structural member that makes the construction of a composite structural member much simpler and therefore cheaper. It is another purpose of the present invention to provide an improved structural member that makes for a stronger composite structural member.

It is a further purpose of the present invention to provide a less expensive composite structural member, and more particularly a less expensive I-beam having a wooden web and metal flanges. It is a further purpose of the present invention to provide a structural member, and more particularly an I-beam having a wooden web and metal flanges, which is stronger and yet simpler to construct.

It is another purpose of the present invention to provide a method for easily and simply making a composite structural member and more particularly an I-beam having a wooden web and metal flanges.

The improved structural member of the present invention comprises a metal flange which is to be used with a web to form a composite structural member. The metal flange is formed with parallel side walls joined by a transverse base wall at one end to define a web-receiving pocket. The side walls of the flange have raised penetrating fastening means which can be moved to penetrate the web to fasten the flange to the web. Each fastening means has a body portion bent outwardly from the side wall, the body portion extending generally in the same direction as the longitudinal direction of the flange. The body portion has a penetrating portion at its free end extending generally toward the pocket. The fastening means are easily formed by punching them out of the side walls.

The above described metal flange is used in the improved composite structural member of the present invention. The composite structural member has a web with at least its outer edge portions made from fastener penetrable material. Preferably at least the outer edge portions of the web, and preferably the entire web, is made from wood or a wood product. One of the metal flanges is mounted on each edge portion of the web. The pocket is sized to snugly receive an edge portion of a web. When the outer edge portion, or the entire web, is made from wood or a wood product, the snug fitting pocket closely confines the web and thus enhances the bearing capacity of the composite structural member. The fasteners on the side walls of the flanges are driven into the web to securely fasten the flanges to the web.

The composite structural member is easily formed by mounting an edge portion of the web in the pocket of the flange to form a structural unit, and then moving the unit in a longitudinal direction with suitable feeding means to cause pressing means to press the raised fastening means on the side walls of the flanges into the web to securely fasten the flange to the web.

In a preferred embodiment of the invention, the flanges are formed with doubled side walls with base wall extensions extending in opposed directions from the free ends of the side walls. This construction allows the pocket portion of the flange to better adhere to the web, particularly when the web is wooden, since the doubled side walls are not as likely, as single side walls, to tend to spread away from the sides of the web. With the side walls of the flange adhering more closely to the web, the shear strength of the composite structural member is increased. In this embodiment, the fastening means are formed in one of the side wall layers or each doubled side wall with an opening, associated with each fastening means, being formed in the other layer of the doubled side wall to allow proper operation of fastening means.

The invention is particularly directed toward a structural member comprising an elongate metal flange having a pair of parallel side walls joined at one end by a transverse base wall to form a web receiving pocket. Each side wall has a plurality of raised penetrating fastening means. Each fastening means has a body portion bent outwardly from the side wall along a first line transverse to the longitudinal direction of the flange, and a penetrating point portion at the free end of the body portion, bent along a second line parallel to the first line, to extend toward the pocket.

The invention is also particularly directed toward a composite structural member having a web with two parallel wide sides and two parallel narrow edges joining the sides, the web having a fastening edge portion adjacent each edge that can be penetrated by fastening means. At least one elongate metal flange is mounted on the web. The flange has a pocket formed by parallel side walls joined at one end by a transverse base wall. The web is mounted in the pocket with one edge abutting the end wall and with the wide sides adjacent the side walls. Each side wall of the flange has a plurality of penetrating fastening means. Each fastening means has a body portion attached at one end to the side wall and extending generally parallel to the longitudinal direction of the flange, and a penetrating point portion at the free end of the body portion, transverse to the longitudinal direction of the flange, penetrating the web.

The invention is further directed toward a method for making the composite structural member comprising providing an elongate web having parallel edges, the web made at least partly of fastener penetrable material along edge portions adjacent the edges. Providing an elongate flange of metal material, the flange having a pair of side walls joined at one end by a transverse base wall to form a pocket. Each side wall has a plurality of raised penetrating fastening means. Each fastening means has a body portion bent outwardly from the side wall along a first line transverse to the longitudinal direction of the flange, and a penetrating point portion at the free end of the body portion, bent along a second line parallel to the first line, to extend toward the pocket. The web is mounted in the pocket of the flange with one edge adjacent the base wall and projecting therefrom, to form a structural unit. The structural unit is then moved in a direction parallel to its longitudinal direction with the first bend line of each fastener leading while the penetrating point portion of each fastening means is pressed into the web.

DESCRIPTION OF THE PREFERRED EMBODIMENTS

Figure 1:
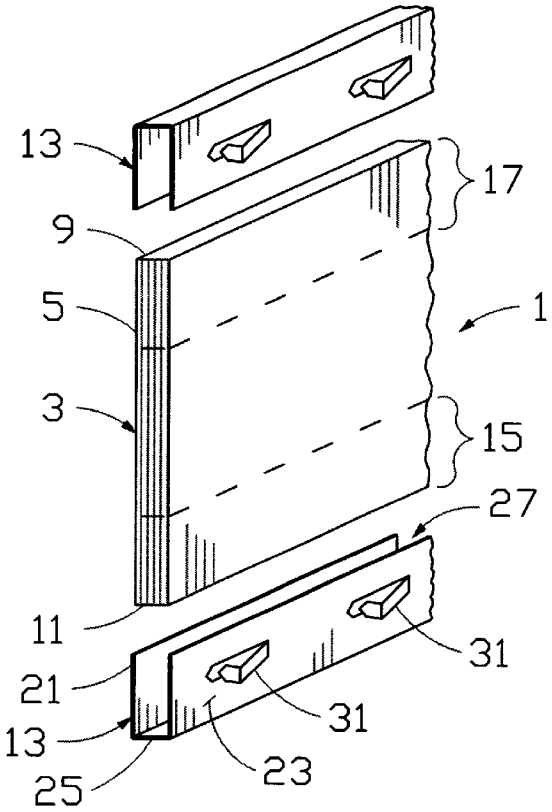
FIG. 1 is an exploded perspective view of the composite structural member.
Figure 2:
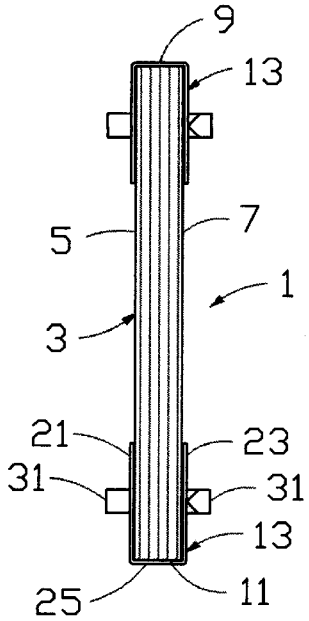
FIG. 2 is an end view of the member.

The composite structural member 1 of the present invention, as shown in FIGS. 1 and 2, has a web 3 at least partly made from fastener penetrable material. The web 3 is elongate and has parallel wide sides 5, 7 and parallel narrow edges 9, 11. At least one metal flange 13 is mounted on one edge 11 of the web 3. Preferably the web 3 has one metal flange 13 on each edge 9, 11 of the web, as shown in FIG. 2 to form a composite beam member.

The web 3 is preferably made in one piece, and preferably made from a wood product such as plywood. Regardless of its construction and the material it is made of, the web requires at least one continuous edge portion 15, adjacent the edge 11 receiving the flange 13, to be made from material that can be penetrated by fasteners such as sheet metal fasteners as will be described. Preferably, the web has two continuous edge portions 15, 17, made from material that can be penetrated by fasteners, one edge portion adjacent each edge 9, 11.

The flange 13 is made from sheet metal and has a pair of parallel side walls 21, 23 joined at one end by a transverse base wall 25 to form a pocket 27 as shown in FIG. 1. The pocket 27 is sized to snugly receive one edge portion 15 of the web 3. The flange 13 is snugly mounted on one edge portion 15 of the web by inserting the edge portion 15 of the web within the pocket 27. The side walls 21, 23 of the flange 13 abut the sides 5, 7 of the web while the base wall 25 abuts the one end edge 11.

Figure 3:
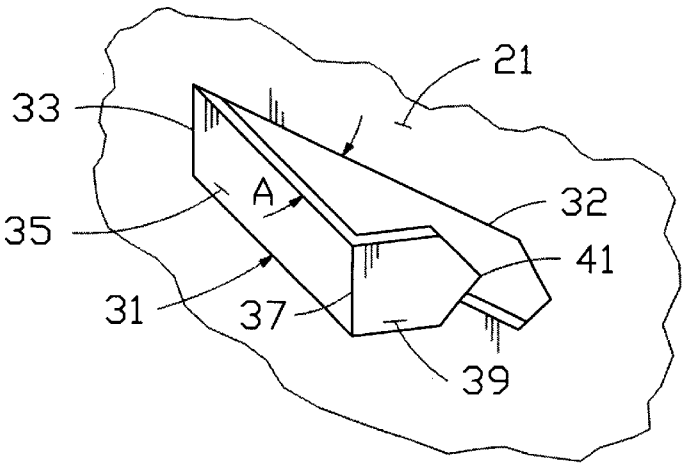
FIG. 3 is a perspective detail view of a fastener.

Penetrating fastening means are provided on the flange 13 for permanently attaching the flange 13 to the web 3. The penetrating fasteners are in the form of teeth 31 formed from the side walls 21, 23 of the flange 13, the teeth 31 adapted to penetrate the web 3 to connect the flange 13 to the web. Each tooth 31 is partially punched out of the side walls 21, 23, as shown in FIG. 3, leaving an opening 32 and then bent once, as shown at first line 33, to have a main body portion 35 connected at one end to the side wall 21 and extending therefrom at a relatively shallow obtuse angle A. The tooth is bent a second time, as shown at second line 37, to have a pointed end portion 39 extending at about right angles to the main body portion 35. The obtuse angle A is such that the point 41 on the pointed end portion 39 of the tooth is normally in the same general plane of the side wall 21. In accordance with the present invention, the teeth 31 are punched out to have them extend generally in the longitudinal direction of the flange with the bend lines 33, 37 generally transverse to the longitudinal direction of the flange. The teeth 31 in one side wall portion 21 preferably extend in the opposite direction to the teeth 31 in the other side wall 23.

The teeth 31 are pressed into the web 3 with the pointed end portions 39 passing through the openings 32 when the composite structural member is assembled as will be described. The end portions 39 of the teeth are made long enough to penetrate the web 3 a sufficient distance to securely hold the flange 13 to the web 3. When the teeth 31 are pressed into the web 3, their main body portions 35 lie generally within the side walls 21, 23. The teeth 31 can be arranged in various patterns and locations on the flange to provide the strongest connection between the flange and web.

Figure 4:
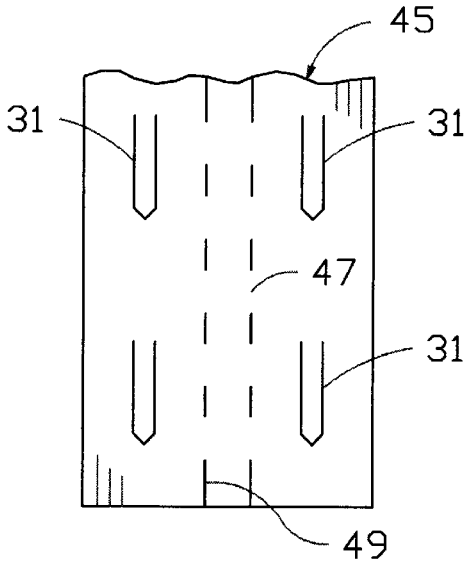
FIG. 4 is a detail plan view of a piece of sheet metal used to make a flange.

The flange 13 is formed from an elongated piece of sheet metal. The sheet metal piece 45, as shown in FIG. 4, cut to the required size, is first stamped to form the teeth 31 in the portions which will form the side walls 21, 23. The teeth could be easily stamped out by moving the piece longitudinally past stamping wheels. The teeth 31 are bent to form the pointed end portions 39 and to have them bent outwardly of the side walls 21, 23. The bending can occur during stamping or after. The metal piece 45 is then bent along fold lines 47, 49 to form the pocket 27.

Figure 5:
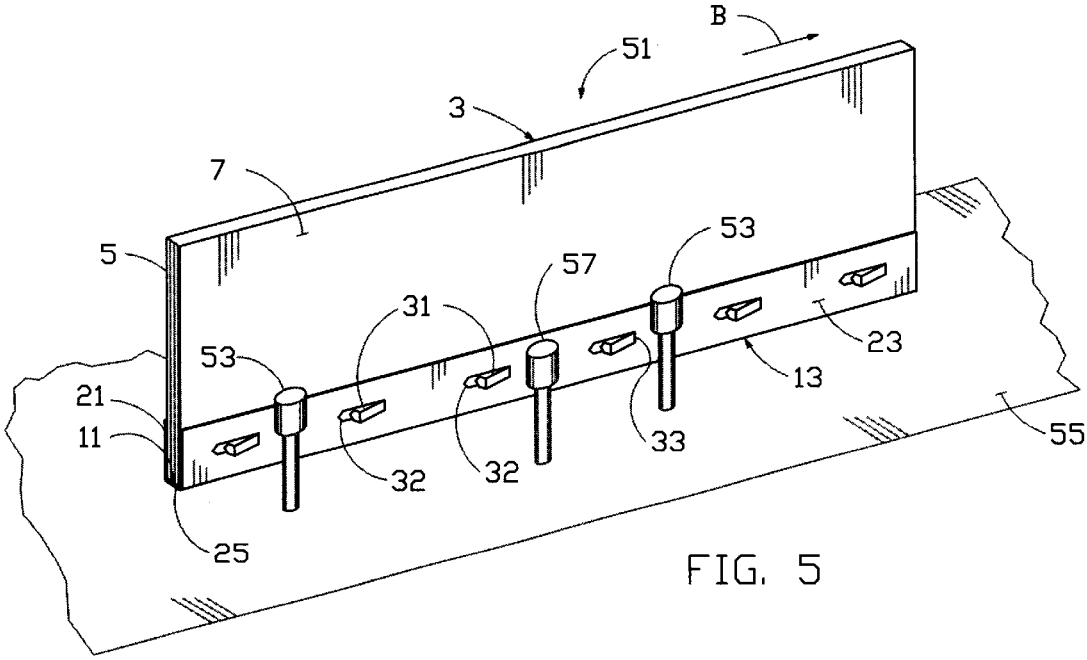
FIG. 5 is a schematic view showing the assembly of the composite structural member.
Figure 6:
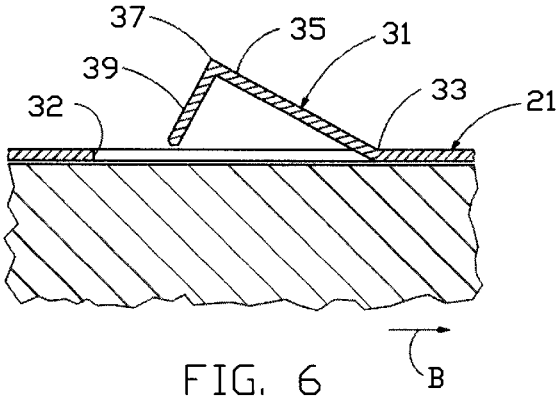
FIG. 6 is a detail cross section view of the flange mounted on the web but not yet joined thereto.
Figure 7:
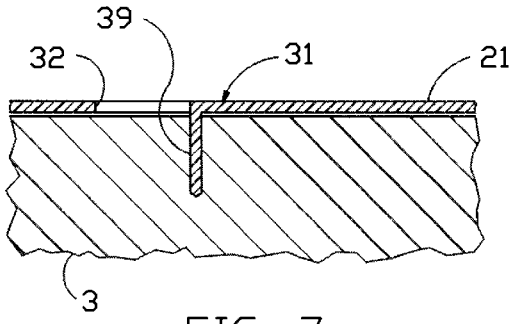
FIG. 7 is a detail view similar to FIG. 6 but with the flange now joined to the web.

To mount the flange 13 to the web 3, the web 3 is mounted within the pocket 27 of the flange 13 to form a structural unit 51 as shown in FIG. 5. The one edge 11 of the web abuts the base wall 25 of the flange and the side walls 21, 23 of the flange lie snug against the sides 5, 7 of the web in the edge portion 15. The assembled unit 51 is then transported longitudinally by suitable feed means' such as pairs of driven feed rollers 53 on a stationary support surface 55. The roller pairs are mounted on opposite sides of the unit 51 and are constructed and positioned to feed the flange 13 and web 3 as a single unit while not interfering with fastening means. The unit 51 is arranged to move in a direction, shown by arrow B in FIGS. 5 and 6 with the first bend 33 of each tooth 31 leading. As the assembled unit 1 is moved longitudinally in the one direction, press rollers 57 located adjacent the side walls 21, 23 of the flange 13, press the teeth 31 into the web 3 through the openings 32 as shown in FIG. 7. If the teeth on both sides extend in the same direction, there are press rollers 57 on both sides to press the teeth on both sides simultaneously into the web. Preferably however the teeth on one side extend in the opposite direction to the teeth on the other side. This arrangement provides greater holding force for the flange on the web. In this case, the unit 51 is moved in one direction first to press the teeth 31 on one side wall 21 into the web and is then moved in a reverse direction to press the teeth 31 on the other side wall 23, which extend in the opposite direction, into the web. The press rollers 57 are arranged to accommodate this back and forth movement. It will be seen that the assembly of the unit 51 to form the composite structural member 1 is quick and simple thereby making the member relatively inexpensive compared to known composite structures.

Figure 8:
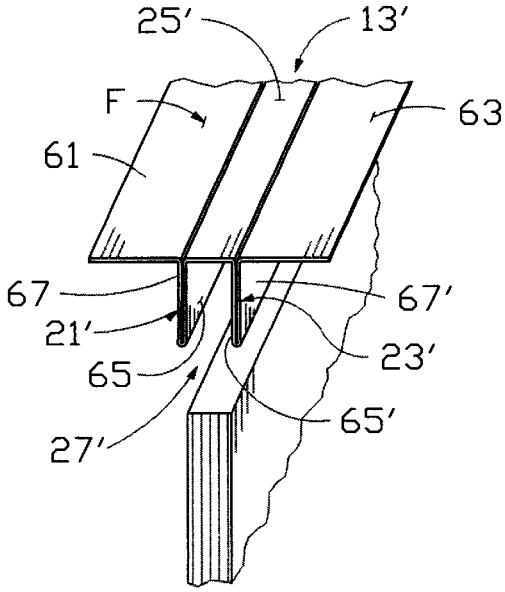
FIG. 8 is a detail perspective view of a preferred embodiment of the flange.
Figure 10:
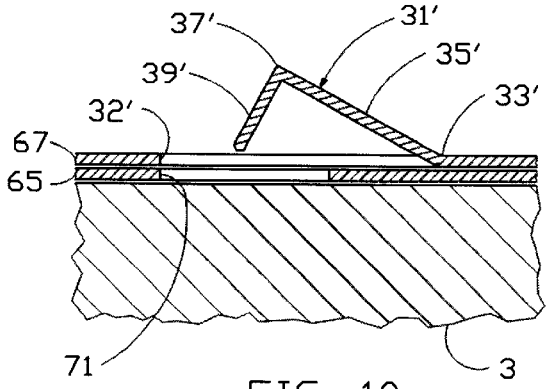
FIG. 10 is a detail cross-section view showing the flange mounted on the web but not yet joined thereto.
Figure 9:
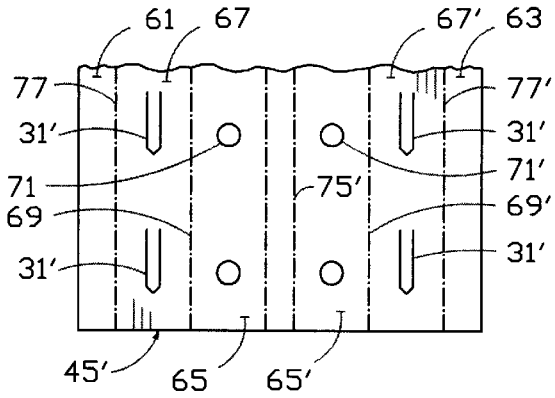
FIG. 9 is a detail plan view of a piece of sheet metal used to make the flange in FIG. 8.
Figure 11:
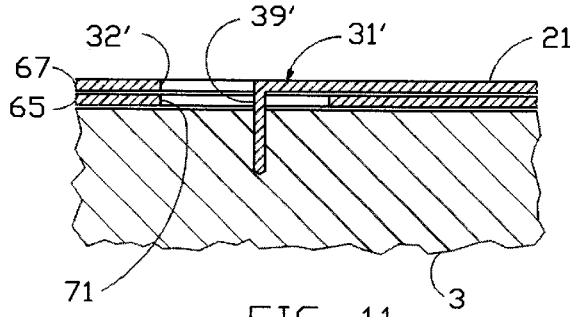
FIG. 11 is a detail view similar to FIG. 10 but with the flange now joined to the web.

In a preferred embodiment of the invention, the flange is provided with double side walls and base wall extensions. As shown in FIGS. 8 and 9, the flange 13' has base wall extensions 61, 63 extending in opposed directions from the ends of the side walls 21', 23', the extensions generally aligned with the base wall 25'. The side walls 21', 23', in more detail, each have an inner wall portion 65, 65' and an outer wall portion 67, 67'. The inner wall portions 65, 65' are joined at one end to the ends of the base wall 25' while the outer wall portions 67, 67' are joined at one end to the base wall extensions 61, 63 respectively. The other ends of the inner and outer wall portions 65, 65' and 67, 67' are joined to each other as shown at 69, 69'. Teeth 31' are punched out in the outer wall portions 67, 67' leaving openings 32' therein. The teeth 31' are similar to teeth 31 and have a main body portion 35' and a pointed end portion 39' both bent along bend lines 33', 37' which are transverse to the longitudinal direction of the flange. Openings 71, 71' are punched out in the inner wall portions 65, 65' of the side walls 21', 23', the openings 71, 71' located opposite the pointed ends 41' of the teeth 31' in the outer wall portions 67, 67'. The metal piece 45' from which the flange is formed, is bent along fold lines 69, 69' to form the doubled side walls 21', 23' as shown in FIG. 10; bent along fold lines 75, 75' to form the pocket 27', and bent along fold lines 77, 77' to form the base wall extensions 61, 63. The flange is then joined to the web in the same manner that flange 13 was joined to web 3, the teeth 31' passing through openings 71, 71' in the inner wall portions 65, 65' into the web. When the flange 13' is joined to the web the base wall extensions 61, 63 extend laterally from web 3 forming, with base wall 25', one flange F of an I-beam structure shown in FIG. 8. The pocket 27' formed by the doubled side walls 21', 23' is not only stronger in shear for the flange but also stronger in shear for the combined web and flange since the pocket will not tend to separate from the web.

The flange has been described above as having the teeth 31' in the outer wall portions 67, 67' of the side walls 21', 23'. The teeth however could also be provided in the inner wall portions 65, 65' of the side walls with the openings 71, 71' provided in the outer wall portions 67, 67' adjacent the teeth and large enough to allow the teeth 31' to be bent outwardly during initial formation of the flange.

Figure 12A:
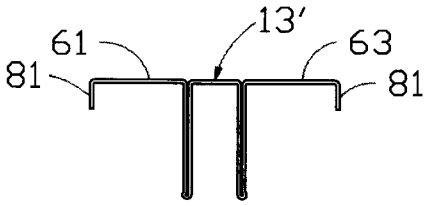
FIGS. 12A and 12B are detail end views of the flange showing variations therein.
Figure 12B:
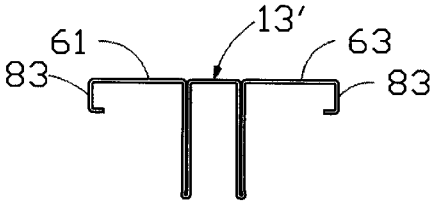

If required, the flanges 13' can be bent in the extension portions 61, 63 to provide stiffening flanges 81 as shown in FIG. 12A or stiffening ribs 83 as shown in FIG. 12B.

The web 3 has been described as being a unitary member. However the web could also be a composite member. It could for example have diagonal truss members with top and bottom stringers on both sides fixing the trusses in place. The flanges could be attached to the stringer members. The stringer members are made of penetrable material and are preferably wood. The truss members could be made of wood or other materials, even metal. The truss member could be in the form of a sinuous metal rod with the stringers suitably attached thereto. The web could also be made in sections to achieve the desired length. The unique flanges of the present invention could have the fasteners arranged to securely splice the web sections together when forming the composite member.

Figure 13:
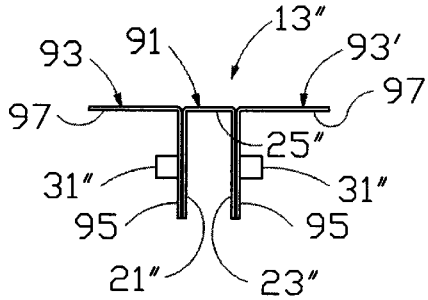
FIG. 13 is a detail end view of another embodiment of the flange.

The flange 13 has also been described as a unitary member. It could also however be made in more than one piece. For example, the flange 13" could have a first central piece 91, as shown in FIG. 13, having parallel side walls 21", 23" joined by a base wall 25" at one end. Second and third outer pieces 93, 93' each having a side wall 95, and a base wall 97 are also provided. The teeth 31" are formed in the side wall 95 of each outer piece 93, 93', the teeth 31" extending in the longitudinal direction of the outer pieces. Openings 99 are formed in the side walls 21", 23" of the central piece 91 in positions where the teeth in the outer pieces will pass through the side walls. The unit is assembled placing the web in the pocket of the central piece, placing the outer pieces with their side walls against the side walls of the central piece and with their base walls aligned with the base wall of the central piece. The assembled unit is moved longitudinally and rollers press the teeth in the outer pieces through the openings in the central piece to join the three pieces to the web to form a flange on one side of the web.

The flange could also be formed by forming a flange member similar to the flange shown in FIG. 8 with a pocket formed by double side walls a central base wall and outer base walls extending in opposite directions from the outer side walls. Openings are formed through both double side walls. A fastener strip with the penetrating teeth punched and bent out of the strip is then provided, one for each side of the side walls. The assembled unit of web, flange unit and fastener strips, one on either side of the flange unit, are fed through rollers which press the teeth in the fastener strips in through the openings in side walls of the flange member and into the web to fasten both the fastener strips and the flange member to the web. This arrangement uses more material but may in some cases be more cost effective than present assembly methods because of the speed with which the unit can be assembled. Other arrangements of the flange are possible.

I claim:

1. A structural member comprising an elongate metal flange having a pair of parallel side walls joined at one end by a transverse base wall to form a web receiving pocket; each side wall having a plurality of raised penetrating fastening means; each fastening means comprising a tooth punched out of the side wall and having a body portion bent outwardly, in a direction away from the pocket, from the side wall along a first line transverse to the longitudinal derection of the flange, the body portion extending generally in the longitudinal direction of the flange, and a penetrating point portion at the free end of the body portion, bent along a second line parallel to the first line, to extend toward the pocket.

2. A structural member as claimed in claim 1 wherein the flange includes outer base walls extending transversely in opposed directions from the side walls, the outer base walls generally aligned with the central base wall.

3. A structural member as claimed in claim 2 wherein each side wall includes an inner wall portion and an adjacent outer wall portion, the central base wall extending between the inner wall portions, each outer base wall extending from an outer wall portion.

4. A structural member as claimed in claim 3 wherein the inner and outer wall portions of each side wall are joined at their sides spaced from the base walls.

5. A structural member as claimed in claim 3 wherein each tooth in each side wall is punched out of one of the inner and outer wall portions and an opening is punched out of the other of the inner and outer wall portions, opposite each tooth.

6. A structural member as claimed in claim 4 wherein each tooth in each side wall is punched out of one of the inner and outer wall portions and an opening is punched out of the other of the inner and outer wall portions, opposite each tooth.

7. A structural member as claimed in claim 3 wherein each tooth in each side wall is punched out of the outer wall portion and an opening is punched in each inner wall portion opposite each tooth in a position allowing passage of the penetrating portion of the tooth.

8. A structural member as claimed in claim 4 wherein each tooth in each side wall is punched out of the outer wall portion and an opening is punched in each inner wall portion opposite each tooth in a position allowing passage of the penetrating portion of the tooth.

9. A structural member as claimed in claim 1 wherein the body portions of the teeth in one side wall extend in one direction and the body portions of the teeth in the other side wall extend in the opposite direction.

10. A structural member comprising a web having two parallel wide sides and two parallel narrow edges joining the sides, the web having an edge portion adjacent each edge that can be penetrated by fastening means; a metal flange member having parallel side walls and a central base wall joining the side walls at one end to form a pocket to single receive an edge portion of the web; a plurality of fastening means formed in each side wall; each fastening means comprising a tooth punched out of the side wall, in a direction away from the pocket, but still attached at one end to the side wall along a line transverse to the longitudinal direction of the flange member; the tooth having a penetrating portion, extending transverse to the longitudinal direction of the flange member, pushed into the edge portion of the web to join the flange to the web.

11. A structural member comprising a web having two parallel wide sides and two parallel narrow edges joining the sides, the web having an edge portion adjacent each edge that can be penetrated by fastening means; a metal flange member having parallel side walls and a central base wall joining the side walls at one end to form a pocket to snugly receive an edge portion of the web, a plurality of fastening means formed in each side wall, each fastening means comprising a tooth punched out of the side wall but still attached at one end to the side wall along a line transverse to the longitudinal direction of the flange member, the tooth having a penetrating portion, extending transverse to the longitudinal direction of the flange member, pushed into the edge portion of the web to join the flange to the web.

12. A structural member as claimed in claim 1 wherein the flange includes outer base walls extending transversely in opposed directions from the side walls, the outer base walls generally aligned with the central base wall.

13. A structural member as claimed in claim 12 wherein each side wall includes an inner wall portion and an adjacent outer wall portion, the central base wall extending between the inner wall portions, each outer base wall extending from an outer wall portion.

14. A structural member as claimed in claim 13 wherein the inner and outer wall portions are joined at their sides spaced from the base walls.

15. A structural member as claimed in claim 13 wherein each tooth in each side wall is punched out of one of the inner and outer wall portions and an opening is punched out of the other of the inner and outer wall portions, opposite each tooth, allowing operation of the tooth.

16. A structural member as claimed in claim 14 wherein each tooth in each side wall is punched out of the outer wall portion and an opening is punched in each inner wall portion opposite each tooth in a position allowing passage of the penetrating portion of the tooth into the web.

17. A method for making a composite structural member having a web and a flange on one edge of the web comprising: providing an elongate web having edge portions of fastener penetrable material; providing an elongate flange of metal material, the flange having a pair of side walls joined at one end by a transverse base wall to form a pocket, each side wall having a plurality of raised penetrating fastening means in the form of teeth, each tooth having a body portion bent outwardly from the side wall, away from the pocket, along a first line transverse to the longitudinal direction of the flange, and a penetrating point portion at the free end of the body portion, bent along a second line parallel to the first line, to extend toward the pocket; the web mounted in the pocket of the flange with its edge portion adjacent the base wall of the flange, the web projecting from the pocket, to form a structural unit; the structural unit moved in a direction parallel to its longitudinal direction with the first bend line of each tooth leading while pressing the penetrating point portion of each tooth into the web.

18. A method as claimed in claim 17 wherein the flange is formed by punching and bending the fastening means in predetermined areas of an elongated piece of sheet metal and folding the piece of sheet metal to form the flange having the parallel side walls joined by the base wall to form the pocket.

19. A method as claimed in claim 18 including the step of punching openings in the piece of sheet metal, each opening associated with a fastening means; folding the piece of sheet metal to form parallel side walls each having an inner wall portion and an outer wall portion, the fastening means located in the outer wall portions and the openings located in the inner wall portions; the fastening means passing through the openings when fastening means are pressed into the web.

20. A method as claimed in claim 19 wherein the fastening means in one side wall extend in the opposite direction to the fastening means in the other side wall.

* * * * *

UNITED STATES PATENT AND TRADEMARK OFFICE

CERTIFICATE OF CORRECTION

PATENT NO. : 6,301,857 B1
DATED : October 16, 2001
INVENTOR(S) : Jan Vrana

It is certified that error appears in the above-identified patent and that said Letters Patent is hereby corrected as shown below:

Column 7,
Line 45, cancel "single" and insert -- snugly --.
Line 57, cancel beginning with " 11. A structural member" to and including "to the web" .

Column 8,
Line 5, insert the following claim:
11. A structural member as claimed in claim 3 wherein the body portions of the teeth in one side wall extend in one direction and the body portions of the teeth in the other side wall extend in the opposite direction.
Line 6, cancel "1" and insert -- 10 --.

Signed and Sealed this

Twenty-ninth Day of July, 2003

JAMES E. ROGAN
*Director of the United States Patent and Trademark Office*